United States Patent [19]

Guymon

[11] Patent Number: 4,968,412

[45] Date of Patent: Nov. 6, 1990

[54] SOLVENT AND WATER/SURFACTANT PROCESS FOR REMOVAL OF BITUMEN FROM TAR SANDS CONTAMINATED WITH CLAY

[76] Inventor: E. Park Guymon, 4085 Eccles Ave., Ogden, Utah 84403

[21] Appl. No.: 490,089

[22] Filed: Mar. 7, 1990

Related U.S. Application Data

[63] Continuation-in-part of Ser. No. 297,670, Jan. 17, 1989, abandoned.

[51] Int. Cl.[5] ..... C10G 1/04

[52] U.S. Cl. ..... 208/390; 208/391

[58] Field of Search ..... 208/390, 391

[56] References Cited

U.S. PATENT DOCUMENTS

| | | | |
|---|---|---|---|
| 4,402,552 | 9/1973 | Bass et al. | 208/391 |
| 4,457,827 | 7/1984 | Chung et al. | 208/391 |
| 4,512,872 | 4/1985 | Chung et al. | 208/391 |

FOREIGN PATENT DOCUMENTS

| | | | |
|---|---|---|---|
| 621961 | 6/1961 | Canada | 208/391 |
| 652173 | 11/1962 | Canada | 208/390 |
| 1145284 | 11/1979 | Canada | 208/391 |
| 1008236 | 8/1981 | U.S.S.R. | 208/390 |

*Primary Examiner*—Asok Pal

*Attorney, Agent, or Firm*—J. Winslow Young

[57] ABSTRACT

This invention involves the separation of clay-contaminated bitumen from sand with a solvent. The bitumen is dissolved with an organic solvent such as condensate from a natural gas well. The clay is separated from the dissolved bitumen and the solvent is recoverd and recycled. The sand is washed with water containing a carefully selected, nonanionic surface active agent to remove residual bitumen and solvent. Prior removal of the clay precludes it from unduly contaminating the water.

16 Claims, 1 Drawing Sheet

SOLVENT AND WATER/SURFACTANT PROCESS FOR REMOVAL OF BITUMEN FROM TAR SANDS CONTAMINATED WITH CLAY

RELATED APPLICATION

This application is a continuation-in-part application of my copending application Ser. No. 07/297,670 filed Jan. 17, 1989 for PROCESS FOR REMOVAL OF BITUMEN FROM TAR SANDS CONTAMINATED WITH CLAY, now abandoned.

BACKGROUND

1. Field of the Invention

This invention relates to a process for recovering bitumen from tar sand and, more particularly, to a low temperature, solvent extraction step followed by a water process step for recovering bitumen from tar sands contaminated with clay, the water process step including the use of a specific surface active agent to preclude contamination of the water with either bitumen residue or clay.

2. The Prior Art

The term "tar sand" refers to a consolidated mixture of bitumen (tar) and sand. Alternate names for tar sands are "oil sands" and "bituminous sands", the latter term being more technically correct in that the sense of the term provides an adequate description of the mixture. The sand constituent of tar sand is mostly alpha quartz, as determined from x-ray diffraction patterns, while the bitumen or tar constituent of the tar sands consists of a mixture of a variety of hydrocarbons and heterocyclic compounds. This bitumen, if properly separated from the sands, may be upgraded to a synthetic crude oil suitable for use as a feedstock for the production of liquid motor fuels, heating oil, and/or petrochemicals.

About 65 percent of all of the known oil in the world is contained in tar sand deposits or heavy oil deposits. Tar sand fields occur throughout the world with the exception of the continents of Australia and Antarctica. Significantly large tar sand deposits have been identified and mapped in Canada, Columbia, Trinidad-Tobago, Venezuela, and the United States. The Canadian tar sand deposits, known as the Athabasca tar sands, are located in the province of Alberta, Canada and are currently being developed. The reserves of bitumen in the Athabasca tar sands alone has been estimated to be approximately 900 billion barrels.

In the United States, approximately 24 states contain known tar sand deposits. However, about 90 to 95 percent of the mapped tar sand deposits are located within the State of Utah and are estimated to include at least 25 billion barrels of oil. While the Utah tar sand reserves appear small in comparison with the enormous potential of the Athabasca tar sands, the Utah tar sand reserves represent a significant energy resource when compared to the United States crude oil proven reserves (approximately 31.3 billion barrels) and with the United States crude oil production of almost 3.0 billion barrels during 1976. Utah tar sand deposits occur in six major locations along the eastern edge of the state with the bitumen content varying from deposit to deposit as well as within a given deposit. Current information available indicates that Utah tar sand deposits average generally less than 10 percent bitumen (by weight), although deposits have been found with a bitumen saturation of up to about 17 percent (by weight).

Athabasca tar sands and Utah tar sands are both also characterized by the presence of clay as a contaminant. The clay is finely divided and dispersed throughout the tar sand deposits, so that it represents a significant obstacle to the efficient processing of tar sands. The commercial processing of the Athabasca tar sands has created vast settling ponds where clay-contaminated water is held to allow the clay to settle. Experience has shown that the clay is so extremely fine that it remains suspended in the water for long periods. A further problem is that significant quantities of bitumen are carried into these settling ponds where it agglomerates and floats on the surface of the water to represent a pollution hazard, particularly for migratory waterfowl, and the like.

Tests have also determined that the Utah tar sands lacks connate water so that the bitumen is bonded directly to the sand grains. This bitumen is also at least one order of magnitude or at least ten times more viscous than bitumen obtained from Athabasca tar sands. Accordingly, the processing of Utah tar sands involves both displacement of the bonded bitumen from the sand grains followed by subsequent phase disengagement of the more viscous bitumen from the residual sand phase. Attempts to use conventional hot water processes that have been successfully applied to the Athabasca tar sands have been unsuccessful for processing Utah tar sands. This failure is readily apparent in light of the recognized differences in both the physical and chemical nature of the Utah tar sands.

A more comprehensive discussion of the athabasca tar sands may be found in the literature including, for example (1) E.D. Innes and J.V.D. Tear, "Canada's First Commercial Tar Sand Development," Proceedings of the Seventh World Petroleum Congress, Elsevier Publishing Co., 3, p. 633, (1967); (2) F.W. Camp, *The Tar Sands of Alberta Canada,* 2nd Edition, Cameron Engineering, Inc., Denver, Colo. (1974); and (3) J. Leja and C.W. Bowman, "Application of Thermodynamics to the Athabasca Tar Sands," *Canadian Journal of Chemical Engineering,* 46 p. 479 (1968).

Additionally, the following U.S. Patents are a few of the patents which have been granted for apparatus or processes directed toward obtaining bitumen from tar sands: U.S. Pat. Nos. 1,497,607; 1,514,113; 1,820,917; 2,871,180; 2,903,407; 2,927,007; 2,965,557; 3,159,562; 3,161,581; 3,392,105; 3,401,110; 3,553,099; 3,560,371; 3,556,980; 3,605,975; 3,784,464; 3,847,464; 3,875,046; 3,893,907; 4,096,057; 4,120,776; 4,160,720; 4,337,143; and 4,410,417. With the exception of U.S. Pat. Nos. 3,605,975, 4,120,776, and 4,160,720, each of the foregoing patents have been directed toward processing any tar sand, but, in particular, Athabasca tar sands.

From the foregoing it is clear that extensive progress has been made in separating bitumen from tar sands, particularly with regard to the Athabasca tar sands. To date no commercially feasible process has been used on the Utah tar sands other than the simple mining, crushing, and blending of the Utah tar sands into an asphalt cement which, when combined with a gravel aggregate, forms an asphalt-based concrete highly suitable for use as a paving material.

In view of the foregoing, it would be a significant advancement in the art to provide a process for recovering bitumen from clay-contaminated tar sands. An even further advancement in the art would be to recover bitumen from clay-contaminated tar sands using a readily available solvent that can be recovered and recycled. Importantly, the process should include a water process step along with the careful use of specific surface active agents to preclude contamination of the water with residual bitumen or clay. Such a novel process is disclosed and claimed herein.

BRIEF SUMMARY AND OBJECTS OF THE INVENTION

This invention relates to a novel, low-temperature process whereby chunks of clay-contaminated tar sand are treated with a readily available solvent. The solvent breaks down the chunks and forms a slurry of tar sand and solvent. Upon agitation, the solvent removes a substantial portion of the bitumen from the sand to form a liquid phase containing solvent and bitumen. A significant fraction of the clay is also recovered in the solvent-/bitumen phase. The resulting liquid phase is drawn off and processed by centrifugation to separate the clay from the solvent and bitumen. The solvent is then removed from the bitumen by distillation. The bitumen-contaminated sand phase is washed with water to which a carefully selected surface active agent has been added in order to recover a second liquid phase of bitumen, solvent, and clay. Advantageously, most of the clay has been removed with the first liquid phase so that very little clay remains to contaminate the water during the water washing process. Great care is exercised in the selection of a surface active agent that will not emulsify the residual bitumen into the water so that the water remains relatively clear.

It is, therefore, a primary object of this invention to provide improvements in the process for recovering bitumen from clay-contaminated tar sands.

Another object of this invention is to provide a novel process for removing clay from tar sand by recovering the clay from solvent used to remove bitumen and clay from the tar sand.

Another object of this invention is to provide a novel process for the solvent recovery of bitumen from clay-contaminated tar sands using a readily available solvent, the process including a water wash for recovering additional bitumen and solvent from the sand.

Another object of this invention is to incorporate a carefully selected surface active agent in the water wash process, the surface active agent having the characteristic of not emulsifying the residual bitumen into the water.

Another object of this invention is to remove residual bitumen from sand grains that are essentially free of connate water without emulsifying the bitumen and thereby trapping residual clay in the residual bitumen so as to maintain a relatively clear water.

Another object of this invention is to provide a low-temperature process for recovering bitumen from a clay-contaminated tar sand.

Another object of this invention is to provide a process for producing a clean sand from a clay-contaminated tar sand.

These and other objects and features of the present invention will become more readily apparent from the following description in which preferred and other embodiments of the invention have been set forth in conjunction with the accompanying drawing and appended claims.

BRIEF DESCRIPTION OF THE DRAWING

The drawing is a schematic flow diagram illustrating a presently preferred embodiment of the novel process of this invention for recovering bitumen from a clay-contaminated tar sand while separating out the clay and producing a clean sand.

DETAILED DESCRIPTION

Figure 1:
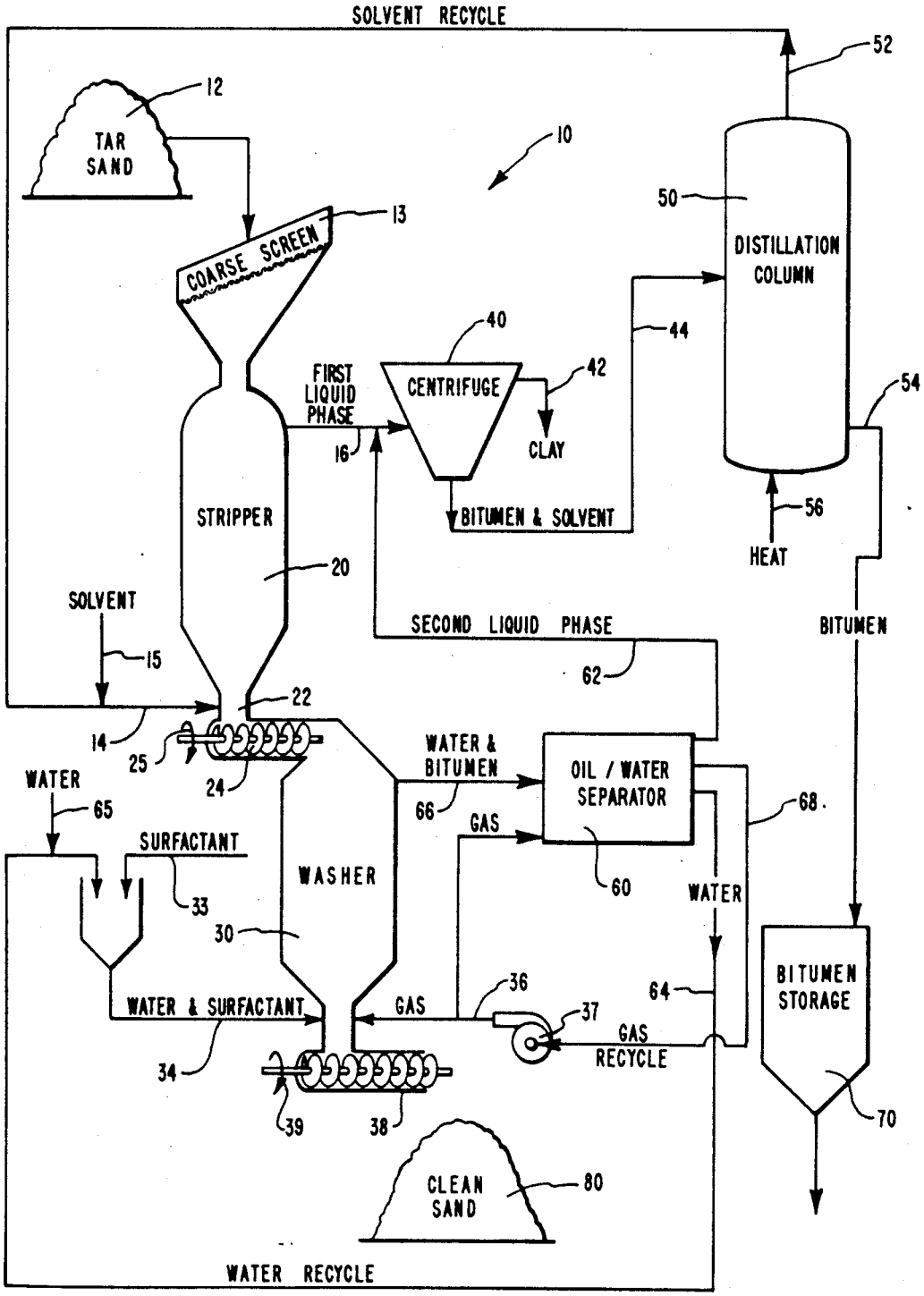

The invention is best understood by reference to the drawing wherein like parts are designated by like numerals throughout in conjunction with the following description.

GENERAL DISCUSSION

Numerous processes for recovering bitumen from tar sand are described in both the patent and technical literature. In general, these references are directed to either the Athabasca tar sands or the Utah tar sands. The processes range among thermal processes, solvent processes, and water processes or a combination of these processes. Interestingly, few of the available references discuss the presence of clay in the tar sand although clay is now recognized as the primary reason that many of these processes are not commercially feasible. For example, any process that relies on the use of water, with or without additives, will result in clay-contamination of the water. This contamination requires extensive separation processes in order to recover and recycle the water since environmental restrictions prohibit the discharge of clay-contaminated water. A further problem is that surface active agents are designed to cause the bitumen to become dispersed or otherwise emulsified in the water phase. This, in turn, creates significant problems because it not only produces a bitumen/water mixture that is difficult to separate, but it also liberates the clay from the bitumen into the water phase.

Thermal processes also encounter problems when clay is present in the tar sand to any appreciable amount. In particular, the extremely fine particle size of the clay means that it will be carried over into the gaseous phase, for example, from any type of thermal, fluidized bed process. Additionally, there is an inherent risk that the clay may sinter on hot surfaces during any coking process involving coked tar sand.

Advantageously, the process of the present invention uses a solvent to disintegrate chunks of tar sand, dissolve substantially all of the bitumen therefrom, while, simultaneously, remove the clay in the bitumen/solvent phase. The resulting solvent, bitumen, and clay phase is processed in a centrifuge to remove the clay so that the remaining solvent/bitumen mixture can be separated through a simple distillation process. Residual bitumen with entrapped clay and solvent is removed from the sand in a low-temperature process using water to which a specific type of surface active agent has been added. This water wash cycle may be repeated several times to assure essentially complete removal of the bitumen and solvent from the sand while the particular surface active agent precludes emulsification of the residual bitumen in the water. Importantly, the surface active agent is selected so as to disengage the bitumen from the sand grains without emulsifying the bitumen. This step is particularly critical for Utah tar sand since they are characterized by the lack of connate water so that the highly viscous bitumen is bonded directly to the sand grains.

The selection of the appropriate surfactant in the water wash step of this process is critical to the success of the process. The wrong surfactant can emulsify residual bitumen leaving a highly contaminated water with bitumen and clay dispersed throughout. This problem exists in the current processing technology practiced in the extraction of bitumen from the Athabasca deposits. If one were to practice this same technology on Utah tar sands, it would not only be impractical due to the high water discard rate in a desert environment but also violate all the laws dealing with clean waters.

Importantly, the surfactant or surface active agent must be able to separate bitumen from sand grains that are characterized by the absence of connate water without simultaneously emulsifying the bitumen into the water phase. Additional surfactant requirements include its being nontoxic to plant growth so that residual surfactant entrained in the spent sand will permit the sand to be ecologically revegetated during reclamation of the excavation site. A further feature is that the surfactant must be biodegradable and the degradation products must not be toxic to plant life for the reasons stated hereinbefore.

Surfactants can be categorized in three general categories: Cationic, Anionic, and Nonionic. I have discovered that a very narrow range of nonionic surfactants provides the necessary characteristics that make this process feasible. Table I sets forth a run of experiments on residual tar sands that had been cleaned with solvent to remove ninety percent of the bitumen. The purpose of the experiment was to demonstrate how this material was wetted by water alone and water to which had been added surface active agents from various types of surface active agents.

Table II outlines my discovery that a surfactant selected from primary or linear alcohols of the ethoxylate family with a narrow range of carbon atoms in the primary alcohol chain provides optimal separation. The number of ethoxy groups on the carbon atoms in the chain are also selected within a relatively narrow range since the greater the number of ethoxy groups on the surfactant molecule, the more soluble the bitumen will be in water. This must be balanced with the fact that the higher number of ethoxy groups causes an increased rate of disengagement of the bitumen from the sand grains.

Correspondingly, the lower range of carbon atoms in the surfactant provides a faster release of bitumen from the sand grains. For example, a surfactant with eight carbon atoms results in a very fast release of bitumen from the sand, much faster than a surfactant with 12 or 15 carbon atoms. However, an undesirable feature is that surfactants of this type also form emulsions between the released bitumen and the water, an event that must be avoided in order to make this process economically feasible.

TABLE I

| Aqueous Medium | Results |
|---|---|
| 1. Water (only) | Not wetted |
| 2. Water with base | Wetted slowly |
| 3. Water with 0.5% Cationic surfactant | Not wetted |
| 4. Water with anionic surfactant | Wetted slowly (wetting due to solution being basic) |
| 5. Water nonionic surfactant (alcohol ethoxylate) | Wetted immediately |

Another important limitation is the amount of the surfactant in the water phase. For example, a surfactant of this invention having eight carbon atoms and three ethoxy groups in a concentration range of three to four percent will produce a complete emulsion. I have found that the maximum allowable concentration of surfactant suitable for the practice of this invention must not exceed about one-half percent, by volume. This must be carefully monitored during the recycle of the water so that the makeup stream of surfactant does not create excess surfactant. This is important since a certain fraction of surfactant will be lost with the bitumen phase and some will be carried away by the damp sand.

The conclusion to be derived from an analysis of the results displayed in Table II is that the two to three ethoxylate units provide a superior surface active agent as long as the clay floaters do not present interface separation problems during continuous processing. The advantage of this surfactant range is that there is no water contamination problem.

Ethoxylate units in the six to eight range present clean interfaces but requires at least ten minutes settling time before the water can be reused. This time requirement may or may not adversely affect the continuous processing strategy. Greater than eleven ethoxylate units renders the surfactant unusable.

Another study was conducted to determine the rate at which the bitumen/solvent residue separates from the sand phase during the water-wash cycle. (Comparisons were made using alcohols with)

TABLE II

Behavior of Nonionic Primary Alcohol Ethoxylates (E.O. Units) with Varying Surfactant Concentrations

| | | |
|---|---|---|
| 2 E.O. units regardless of concentration | The water layer clear, no color | Lots of clay floaters at both interfaces |
| 3 E.O. units regardless of concentration | Same as above | Same as above |
| 6 E.O. units | | |
| .5% | Water layer light brown | Settles out, few clay floaters[1] |
| .3% | Water layer colorless | Settles out, few clay floaters[1] |
| 7 E.O. units | | |
| .5% | Water layer light brown | Very few clay floaters[1] |
| .3% | Water layer colorless | Very few clay floaters[1] |
| 8 E.O. units | | |
| .5% | Water layer light black | At end of 10 minutes no clay floaters[2] |
| .3% | Water layer dark brown | At end of 10 minutes no clay floaters[2] |
| 11 E.O. units | Water layer is black-black, with no observed change within one hour | Too dark to tell |

[1]Settled out leaving a clear solution within 5 minutes settling time.
[2]The black layer in the water contains oil and clay. A layer of fine, tan clay settles out as the solution clears up. This clearing takes place within 10 minutes.

eight, twelve and fifteen carbon atoms, C-8, C-12, and C-15, respectively, and with ethoxylate units ranging between three and eight. The studies found that the C-12 and C-15 alcohols were identical with both three and seven ethoxylate units, the seven ethoxylate units being faster. Surprisingly, the C-8 alcohol produced the fastest and cleanest separation with the greater number of ethoxylate units. The results of this study are summarized in Table III.

In conclusion, the C-8 alcohol with six to eight ethoxylate units appears to be the ideal surface active agent for this process. This surfactant gave the best rate of recovery, a clean separation of phases with no clinging clay/bitumen in the water/bitumen interface. Additionally, this surfactant gave the highest percentage of bitumen recovery with the least number of process steps. However, great care must be taken to assure that even this surface active agent is maintained at less than 0.5 percent, by volume, since even at three percent, by volume, this surfactant produces a complete emulsion.

The action involved with this surfactant appears to be the displacement or phase disengagement of the bitumen from the sand grains with the water/surfactant solution. Importantly, the absence of connate water between the sand grains and the bitumen appears to be the primary requirement for the specificity of the surface active agent particularly when this requirement is coupled with the equally important requirement that the surface

TABLE III

| Comparison of Carbon Atoms in Alcohol Chain Length with Number of Ethoxylate Units | | | |
|---|---|---|---|
| Alcohol Chain | Ethoxylate Units | Results | % of Bitumen left on sand after 1 minute surfactant wash |
| C-8 | 6 | Very large oil drops (¼ in.) Separation complete in 30 seconds | 14% |
| C-8 | 8 | Very large oil drops (¼ in.) Separation complete in 30 seconds | 18% |
| C-15 | 7 | Oil drops (⅛ in.) work way out for 4–5 minutes | 33% |
| C-15 | 3 | Oil drops (⅛ in.) without agitation still coming out after 10 minutes | 36% |

(active agent does not cause an emulsification of the bitumen into the water phase.)

THE PREFERRED EMBODIMENT

Referring now more particularly to the drawing, a schematic of the basic elements of the novel progress of this invention is shown generally at 10 and includes a stripper 20, a water washer 30, a centrifuge 40, a distillation column 50, an oil/water separator 60 and a bitumen storage 70. Tar sand 12 is introduced into stripper 20 through a coarse screen 13 which prevents excessively large pieces of tar sand 12 from entering stripper 20 where they could possibly damage an auger 24 at the bottom of stripper 20. The lower end of stripper 20 is constricted by a throat 22 which directs downwardly falling sand into auger 24. Auger 24 is rotated as indicated by arrow 25 to transfer sand from stripper 20 to water washer 30.

Solvent 14 is an organic solvent such as hexane, pentane, gasoline, or the like, and is introduced into stripper 20 adjacent throat 22. Solvent 14 is added in the ratio of about 20 to 30% by weight of Utah tar sand, and as such, becomes saturated with bitumen upon vigorous agitation. Solvent 14 flows upwardly through tar sand 12 where it not only breaks up the agglomerated pieces of tar sand 12 but also dissolves bitumen which, in turn, carries away clay that is interspersed in the bitumen. Solvent 14 dissolves the bitumen so that the resulting first liquid phase 16 includes bitumen dissolved in solvent and suspended clay.

Stripped sand from stripper 20 is directed by auger 24 into water washer 30 where it falls downwardly and is agitated by an upwardly flowing stream of water/surfactant 34 and gas 36 from a compressor 37. Gas 36 is selected from any suitable gaseous medium that does not contain oxygen. Suitable gases include nitrogen, carbon dioxide, methane, or the like. The combination of water/surfactant stream 34 along with gas 36 creates a highly agitated slurry of sand inside water washer 30. The result is that residual bitumen is removed by water and surfactant 34 and carried upwardly into an oil/water separator 60 as a water/bitumen stream 66.

A surfactant 33 is mixed with water 32 to produce the desirable ratio of surfactant to water in water/surfactant stream 34. Importantly, surfactant 33 is carefully selected from a range of surface active agents so as to provide a surfactant that is nontoxic to plant growth so that spent sand from this process can be readily revegetated with no adverse environmental effects. It is also important that surfactant 33 is biodegradable for the same reasons. However, the most important feature of surfactant 33 is that it will not emulsify oil in water but is an oil surfactant that helps displace the residual bitumen and bitumen-solvent residue from the sand without emulsifying the bitumen. Surfactant 33 also aids in the formation of bitumen/solvent droplets within the water/surfactant phase 34. These droplets are large enough that they will rise out of the sand and water phase. The more active the surfactant 33 the larger the droplets and the faster the separation process.

The sequence involved in water washer 30 may be repeated in additional stages if it is determined that a single pass through water washer 30 is insufficient to remove residual bitumen. An auger 38 at the base of water washer 30 is turned as indicated by arrow 39 to remove clean sand 80 from water washer 30.

The mixture of gas and water/bitumen stream 66 is introduced adjacent the lower end of oil/water separator 60 where it is agitated by additional gas 36. Residual bitumen and solvent are separated float to the surface where it is removed from oil/water separator 60 as a second liquid phase 62. The second liquid phase 62 joins the first liquid phase 16 where they are processed by centrifuge 40. Water 64 is removed from oil/water separator 60 and recycled as water 34 back into water washer 30 after being supplemented with make up water 65 and surfactant 33.

First liquid phase 16 is joined by second liquid phase 62 and they are both introduced into centrifuge 40. Suspended clay is separated out as clay 42 while the resulting solvent/bitumen stream 44 is directed to distillation column 50.

Distillation column 50 is a simple distillation process for separating solvent 52 from bitumen 54. Heat 56 provides sufficient thermal energy for distillation column to cause solvent 52 to become separated from bitumen 54. Solvent 52 is recycled back to stripper 20 where it is blended with make up solvent 15, if any is required to compensate for solvent carried over with bitumen 54, to become solvent stream 14. Bitumen 54 is directed to bitumen storage 50.

The following examples are merely illustrative of the process of the present invention and are not intended to be restrictive in any manner in setting forth the novel process of this invention.

EXAMPLE 1

Approximately one kilogram of tar sand obtained from the Asphalt Ridge tar sand deposit near Vernal, Utah, was placed in a two liter vessel. The tar sand was in rough chunks, each chunk about 10 cm in diameter. Solvent in the amount of 210 grams was added to the vessel after which the vessel was sealed. The solvent completely disintegrated the chunks of tar sand in about 35 seconds without agitation. The resulting slurry was then vigorously agitated by shaking the vessel after which the liquid phase was decanted. The liquid phase consisted of 89 grams solvent, 77 grams bitumen and 76 grams clay for a total weight of 242 grams.

Water (400 ml.) containing 0.5% (by weight) of the specially selected surfactant of this invention was added to the sand residue in the vessel. The vessel was shaken vigorously to agitate the sand and water slurry. At this point the sand appeared to be clean although there were some residual oil droplets that worked their way out of the sand if the sand were lightly agitated so as to remain loose. There were three distinct, separable layers having very definite interfaces. The top layer consisted of solvent and bitumen with a limited quantity of clay, a middle layer of water slightly cloudy from small amounts of clay and a lower layer of sand containing a limited amount free oil (bitumen/solvent).

The sand was washed again using an additional 100 ml of water and agitated by bubbling a gas through the mixture. The sand at this stage appeared clean and was analyzed to reveal that at least 94.5% of the bitumen had been removed. The remaining bitumen was present as small droplets interspersed in the sand and could be removed by subsequent washing.

The solvent-rich bitumen from each of the prior steps was combined and introduced into a centrifuge where it was processed at 5,000 g's for 10 minutes. The clay portion was removed through this centrifugation process so that the bitumen (after distillation to remove the solvent) contained only 0.7% clay (by weight).

EXAMPLE 2

To provide a preliminary indication of the effect of temperature upon this process, all materials were cooled in ice water so that the temperature of the process was between 4° C. and 6° C. The same process was used as in Example 1, above. Large, approximately 10 cm, chunks of tar sand (1058 grams) were used to fill the stripper chamber. Solvent, 234 grams, was added to the chamber where it took 2.3 minutes for the solvent to soak into the chunks causing them to collapse into a stirrable slurry. The container was agitated by shaking it for thirty seconds. A portion (106 grams) of the solvent-bitumen-clay mixture was removed and was found to contain 44 grams solvent, 34 grams bitumen and 28 grams clay.

Chilled ice water (400 ml) containing 0.5% (by weight) of the specially selected, nonfoaming surfactant was added and the vessel shaken vigorously for one minute. The sand phase was relatively clean and contained numerous small oil droplets which required three additional washing cycles to produce a clean sand free of oil droplets. The bitumen was 94.7% (by weight) removed during this experimental run. Importantly, the surface active agent was carefully selected so as to disengage the bitumen from the sand grains without emulsifying the bitumen into the water phase.

The partial removal of solvent from the first step left extra clay which could not be removed easily. The layer of suspended clay particles was partially in the solvent/bitumen phase and partially in the water phase. This clearly demonstrates the importance of removing the major portion of the clay with the solvent phase.

The foregoing combined liquid phases were removed from the vessel and an additional aliquot of solvent was added to the sand residue. The mixture was agitated by shaking slightly and in about thirty minutes the remaining clay particles had settled to the bottom resulting in a very clean separation between the solvent-bitumen phase and the water phase. The water phase was very cloudy due to the extra clay present. After several hours without agitation the clay had settled out of the cold water leaving a slightly cloudy water layer over a clean layer of clay on the bottom.

The solvent-bitumen phases from the first and second steps were combined and processed by centrifugation at 5000 g's for ten minutes. The bitumen contained residual clay of 0.5% (by weight).

EXAMPLE 3

Using the same equipment, 1143 grams of 13% (by weight) bitumen-content, Utah tar sands were contacted with 234 grams of solvent. After 135 seconds the tar sand had collapsed into a slurry in the absence of agitation. The mixture was then vigorously agitated for one minute by shaking the vessel. The solvent-bitumen-clay phase (215 grams) was decanted and analyzed to contain (by weight) 57% solvent, 31% bitumen, and 12% clay.

Water (2100 ml) containing the carefully selected surface active agent 0.5% (by weight) was added to the vessel and agitated vigorously by shaking for one minute. Excellent separation into clean sand and water was obtained upon standing. Medium size oil droplets of solvent-dissolved bitumen were observed interspersed in the sand. The bitumen droplets were too heavy to float to the surface of the water. The addition of 40 grams of solvent gave the droplets of bitumen sufficient upward mobility to float on the surface of the water. The resulting layers of solvent-bitumen on top of the water layer had a very clean separation. Importantly, the surface active agent was carefully selected so that it effectively disengaged the bitumen from the Utah tar sand without emulsifying it into the water.

The oil/water mixture was poured off the sand and allowed to stand to provide an excellent, separable interface. The resulting solvent-bitumen phase contained (by weight) 56% solvent, 37% bitumen, and 7% clay.

A second washing with 100 ml of ice water was shaken vigorously with the sand and resulted in the medium-size oil droplets being broken into numerous small droplets. These small droplets remained in the sand and did not float to the surface of the water. The addition of 0.5 ml of the specific surface active agent of this invention followed by shaking created the formation of large droplets of oil. Light agitation of the sand using gas bubbles allowed these large droplets to move out of the sand and float to the surface where they could be skimmed from the water.

A repeat washing and agitation of the sand resulted in additional oil being recovered. A third washing produced no additional oil recovery. The bitumen recovery rate was 97% (by weight). The solvent recovery was 88% since no steps were taken to recover solvent carried over in the sand or to preclude losses through evaporation.

The solvent used in this process was obtained from the numerous natural gas wells in the vicinity of the tar sand deposits. The solvent was condensate collected at the well head and is frequently referred to as "casing head gas" or "drip gas". This solvent consists generally of about 20% pentane, 70% hexane, and 10% heavier compounds (by weight) ranging between $C_5$ to $C_9$ hydrocarbons.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A process for removing bitumen from a tar sand contaminated with clay comprising:

obtaining a tar sand consisting of bitumen and clay mixed with sand;

introducing said tar sand into a stripper vessel;

dissolving said bitumen with a solvent, said solvent also removing said clay from said sand into a liquid medium formed with said solvent and bitumen;

removing said liquid medium from said sand; and washing said sand with water to which a nonionic surface active agent has been added to remove residual bitumen from said sand, said surfactive agent comprising a linear alcohol having carbon atoms within the range on the order of about eight to fifteen carbon atoms and ethoxylate units on the carbon atoms within the range on the order of about two to eight ethoxylate units, said surfactant being present in said water in an effective amount less than about 0.5 percent, by volume.

2. The process defined in claim 1 wherein said dissolving step comprises obtaining said solvent from a condensate from a natural gas source.

3. The process defined in claim 1 wherein said dissolving step comprises obtaining said solvent from a group consisting of organic solvents.

4. The process defined in claim 1 wherein said removing step includes separating said clay from said liquid medium.

5. The process defined in claim 4 wherein said separating step includes recovering said solvent from said liquid medium by evaporating said solvent from said bitumen thereby recovering said solvent and producing bitumen.

6. The process defined in claim 5 wherein the recovering step includes recycling said solvent to said stripper vessel and amending said solvent with additional solvent.

7. The process defined in claim 4 wherein said separating step includes removing said clay from said liquid medium by centrifugation of said liquid medium.

8. The process defined in claim 1 wherein said adding step includes agitating said sand in said water by passing a gas upwardly through said sand.

9. The process defined in claim 1 wherein said agitating step is followed by removing said residual bitumen from said water by passing said water and residual bitumen into an oil/water separator, said residual bitumen floating to the surface of said oil/water separator.

10. A process for recovering bitumen from a tar sand having a bitumen, clay, and sand content comprising:

obtaining a tar sand having a bitumen, clay, and sand content;

sizing said tar sand and introducing said sized tar sand into a stripper vessel;

stripping said clay and said bitumen from said sand by dissolving said bitumen with a solvent, said clay, bitumen and solvent forming a liquid medium, and leaving a sand residue;

removing said liquid medium from said sand residue;

separating said clay from said liquid medium;

recovering said bitumen from said liquid medium by evaporating said solvent from said bitumen; and washing said sand residue with water to which a carefully selected nonanionic surfactant has been added in an effective amount less than about 0.5 percent, by volume, said surfactant comprising a linear alcohol having carbon atoms within the range on the order of about eight to fifteen carbon atoms and ethoxylate groups within the range on the order of about two to eight ethoxylate groups.

11. The process defined in claim 10 wherein said stripping step includes obtaining said solvent as a condensate from a natural gas well head.

12. The process defined in claim 10 wherein said separating step includes removing said clay from said liquid medium by centrifugation of said liquid medium.

13. The process defined in claim 10 wherein the recovering step includes recycling said solvent to said stripper vessel and amending said solvent with additional solvent.

14. The process defined in claim 10 wherein said adding step includes agitating said sand in said water by passing a gas upwardly through said sand.

15. The process defined in claim 10 wherein said agitating step is followed by removing said residual bitumen from said water by passing said water and residual bitumen into an oil/water separator, said residual bitumen floating to the surface of said oil/water separator.

16. A process for recovering bitumen from a tar sand having a clay contaminant in the bitumen comprising:

mining a tar sand having a sand bonded by a bitumen and clay matrix;

screening said tar sand to remove large pieces of tar sand while introducing the tar sand into a stripper;

obtaining a solvent from a wellhead of a natural gas well, the solvent comprising a hydrocarbon condensate;

dissolving said bitumen by introducing said solvent into said stripper, the solvent releasing said sand from said bitumen and said clay and forming a liquid medium with said bitumen and said clay;

removing said clay from said liquid medium by processing said liquid medium in a centrifuge;

separating said solvent from said bitumen by evaporating said solvent in a distillation column;

recycling said solvent to said stripper;

washing said sand in a washer by passing water and a gas upwardly through said sand in said washer, said water including a carefully selected, nonanionic surface active agent, said surface active agent being present in an effective amount less than about 0.5%, by volume, and comprising a linear alcohol having carbon atoms within the range on the order of about eight to fifteen carbon atoms and ethoxylate groups within the range on the order of about two to eight ethoxylate groups, said water removing residual bitumen from said sand;

floating said bitumen from said water by passing said water into an oil/water separator;

recycling said water back to said washer; and discharging sand from which bitumen has been removed from said washer.

* * * * *